US005647216A

United States Patent [19]

Garrett

[11] Patent Number: 5,647,216

[45] Date of Patent: Jul. 15, 1997

[54] HIGH-POWER THERMOACOUSTIC REFRIGERATOR

[75] Inventor: Steven L. Garrett, State College, Pa.

[73] Assignee: The United States of America as represented by the Secretary of the Navy, Washington, D.C.

[21] Appl. No.: 520,974

[22] Filed: Jul. 31, 1995

[51] Int. Cl.[6] ..... F25B 9/00

[52] U.S. Cl. ..... 62/6; 62/467

[58] Field of Search ..... 62/6, 467

[56] References Cited

U.S. PATENT DOCUMENTS

| | | | |
|---|---|---|---|
| 4,398,398 | 8/1983 | Wheatley et al. . | |
| 4,489,553 | 12/1984 | Wheatley et al. . | |
| 4,722,201 | 2/1988 | Hofler et al. . | |
| 5,165,543 | 11/1992 | Bennett | 62/6 |
| 5,275,002 | 1/1994 | Inoue et al. | 62/467 X |
| 5,319,938 | 6/1994 | Lucas | 62/467 X |
| 5,339,640 | 8/1994 | Reinke . | |

OTHER PUBLICATIONS

J. Acoust. Soc. Am., vol. 93, No. 4, "Thermoacoustic Life Sciences Refrigerator," Garrett et al., Apr. 1993 p. 2364.

R & D Magazine, vol. 35, No. 11, "1993 R & D 100 Awards", Oct. 1993, p. 22.

NASA Report No. LS-10114, Steven L. Garrett, "Thermoacoustic Life Sciences Refrigerator—A Preliminary Design Study", Jun. 1992.

"'Green' Refrigerators", IEEE Spectrum, pp. 25–30, Aug. 1994.

"The Coolest Sound", Technology Review, pp. 17–19, Oct. 1994.

Gregory W. Swift, "Thermoacoustic Engines and Refrigerators", Phyisics Today, pp. 22–28, Jul. 1995.

*Primary Examiner*—Christopher Kilner

*Attorney, Agent, or Firm*—Donald E. Lincoln; William C. Garvert

[57] ABSTRACT

A high-power thermoacoustic refrigerator including a half-wave length resonator, first and second drivers located in housings at first and second ends of said resonator, two pusher cones, a plurality of heat exchangers, a first and second stack, utilizing a compressible gas mixture capable of being tuned to the driver resonance frequency, a half-wave length tube, fluids disposed within said heat exchangers for transferring heat, and voice coils wired 180 degrees out of phase for compressing said compressible fluid into a standing wave oscillating within said resonator.

6 Claims, 4 Drawing Sheets

FIG. 3
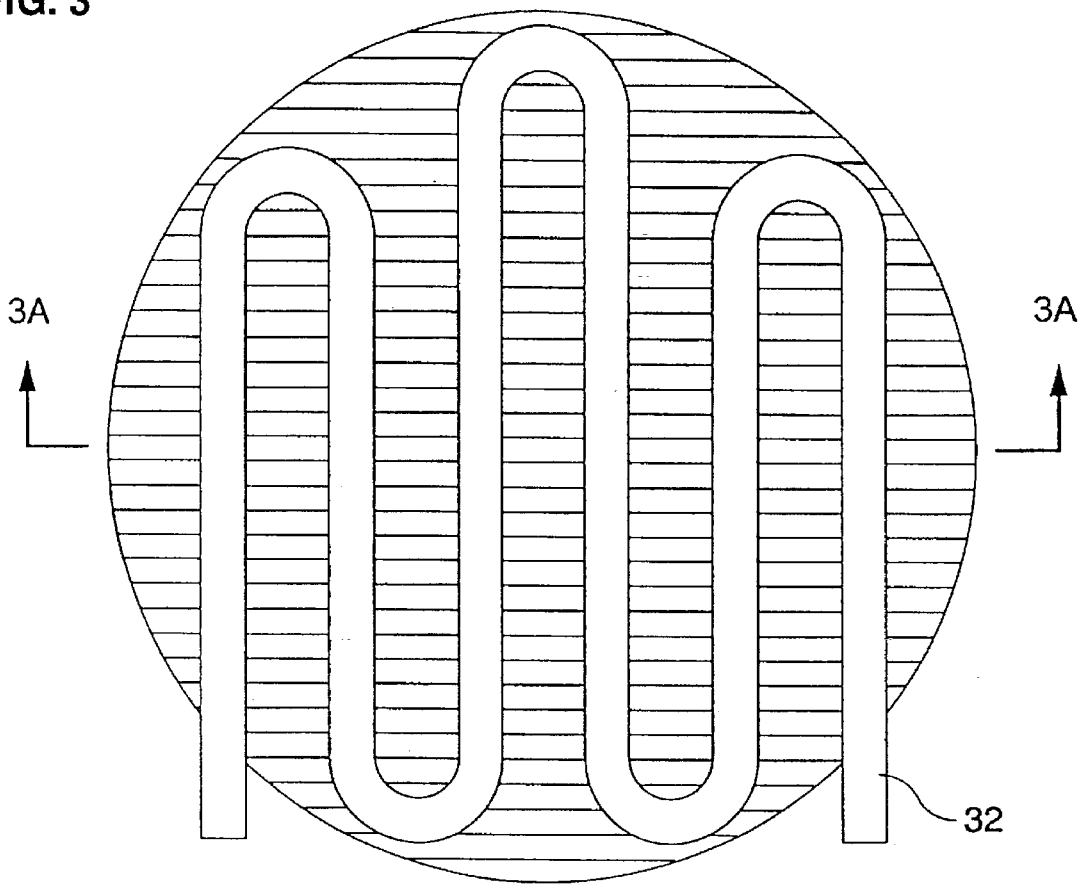
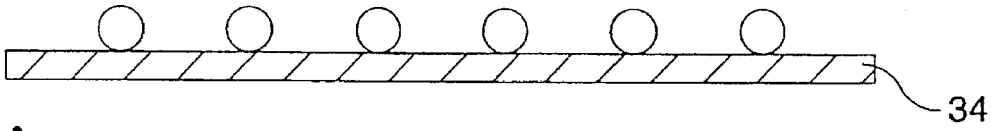
FIG. 3A

HIGH-POWER THERMOACOUSTIC REFRIGERATOR

BACKGROUND OF THE INVENTION

1. Field of the Invention

This invention relates to refrigerators and, more specifically, to thermoacoustic refrigeration pumps.

2. Description of the Related Art

Over the past thirteen years, there has been an increasing interest in the development of thermoacoustical cooling engines (pumps) for a variety of commercial, military, and industrial applications. Interest in thermoacoustic cooling has escalated rapidly with the production ban of chlorofluorocarbons (CFCs) which will be imposed worldwide at the end of 1995. The increased interest in thermoacoustic cooling is due to the fact that thermoacoustic refrigeration can be accomplished by using only inert gases which are nontoxic and, in addition, do not contribute to stratospheric ozone depletion nor to global warming.

Prior to the present invention, electrically driven thermoacoustic engines had been optimized for scientific research purposes, but were only capable of providing a few Watts of useful cooling. See S. L. Garrett, J. A. Adeff and T. J. Hofler, "Thermoacoustic Refrigerator for Space Applications," *Journal of Thermophysics and Heat Transfer,* Vol 7, No. 4, pp. 595–599 (1993). Earlier designs, see T. J. Hofler, I. C. Wheatly, G. W. Swift, and A. Migliori, "Acoustic Cooling Engine," U.S. Pat. No. 4,722,201 to T. J. Hofler, et al., and see Garrett, et al. above, typically incorporated a one-quarter wavelength resonator driven by a single loudspeaker at one end and containing a single stack and one pair of primary heat exchangers in close proximity to either end of the stack.

For the large heat loads required in this high-powered thermoacoustic refrigerator, the heat exchangers from earlier thermoacoustic refrigerators, U.S. Pat. No. 4,722,201 and see S. L. Garrett et al., "Thermoacoustic Refrigeration for Space Applications," *Journal of Thermophysics and Heat Transfer,* Vol 7, No 4, pp 595–599 (1993), which relied on thermal conduction through solid metal, were grossly inadequate. The high-powered thermoacoustic refrigerator described in this specification uses a novel gas-to-liquid heat exchanger which is capable of transporting hundreds of Watts of heat to and from the stack. See: S. L. Garrett, "Thermoacoustic Life Sciences Refrigerator: Heat Exchanger Design and Performance Prediction." unpublished technical report, June 1992, and S. L. Garrett, D. K. Perkins and A. Gopinath, "Thermoacoustic Refrigerator Heat Exchangers: Design, Analysis and Fabrication," *Heat Transfer* 1994, proceedings of the Tenth International Heat Transfer Conference, Vol 4, pp 375–380 (Aug. 1994).

SUMMARY OF THE INVENTION

It is an object of this invention to provide a new and improved high-powered thermoacoustic refrigerator. More specifically, it is an object of the invention to provide a new and improved high-powered thermoacoustic refrigerator that is an electrically driven heat pumping device capable of efficiently and inexpensively exploiting the principles of thermoacoustic heat transport. It is a further object of the invention to provide a new and improved high-powered heat exchanger that is capable of providing hundreds of watts of cooling power over wider temperature spans between hot and cold heat-exchangers of 20 to 70 degrees Celsius (20° C.<$\Delta T_{ex}$<70° C.). This combination of heat pumping capacity and range of temperature spans is of particular commercial interest in a wide variety of applications including, but not limited to, domestic food refrigerators/freezers, preservation of medical supplies and samples, and removal of heat dissipated by electronic components within devices such as computers, video displays, telecommunication devices, and military consoles.

In a preferred embodiment the present invention employs a half-wavelength resonator driven at both ends with two stacks and two pairs of heat exchangers in close proximity to the stacks. The use of dual stacks and four heat exchangers increases the overall heat pumping capacity while providing flexibility in the heat exchange systems and making the refrigerator of this dual-stack design more compact and efficient than a single-stack design for comparable heat pumping capacity. This new high-power, dual-stack thermoacoustic refrigerator incorporates several modifications to the resonator shape, heat exchangers and their connections to the heat load and thermal exhaust system, loudspeakers, and working fluid which increases heat pumping capacity and improves efficiency, endurance and manufacturability.

These and other objects and advantages are provided by a dual-loudspeaker, dual-stack thermoacoustic refrigerator which has an advantage of increased power and increased cooling capacity in a component system which is better able to exploit the output of each acoustic driver due to the increased acoustic impedance of one driver due to the operation of the other driver. This increased acoustic impedance reduces the required displacement of the loudspeakers and hence increases their lifetime due to reduced metal fatigue. The resonator shape also reduces turbulence losses and losses associated with the generation of higher harmonics and shock waves. Resonant operation of the loudspeakers increases efficiency by allowing the movement of a larger mass and therefore heavier voice coils, and less power dissipation due to Joule heating. The low loss (metal) suspension system also reduces power loss due to mechanical dissipation.

A binary mixture of two inert gases as the thermoacoustic working fluid permits an adjustment in the speed of sound of the gas mixture and hence the frequency of the half-wavelength resonance of the resonator. By varying the acoustic resonance of the gas and the resonator to coincide with the mechanical resonance of the loudspeaker, it is possible to substantially increase the overall efficiency of the system, (the ratio of Watts of useful heat pumping to Watts of electrical power consumed by the loudspeaker). The use of short fin length and high fin density on the leading edge on a fluid-filled tube gas-to-liquid heat exchanger provides efficient gas-to-liquid heat exchange capable of transferring hundreds of Watts of heat with only small temperature differences between the gas and the liquid.

The design of a Quasi-Cascade serial sequence of heat exchangers with hot and cold counterflow directions arrangement exploits the existence of two stacks to make a stable fluid flow system without additional flow control components and improves thermodynamic efficiencies by reducing the required temperature span of each individual stack to produce the overall temperature reduction required for a given application.

BRIEF DESCRIPTION OF THE DRAWINGS

FIG. 3 is a plan view of the heat exchanger.

FIG. 3A is a cross-sectional view of the heat exchanger.

DETAILED DESCRIPTION

Figure 1:
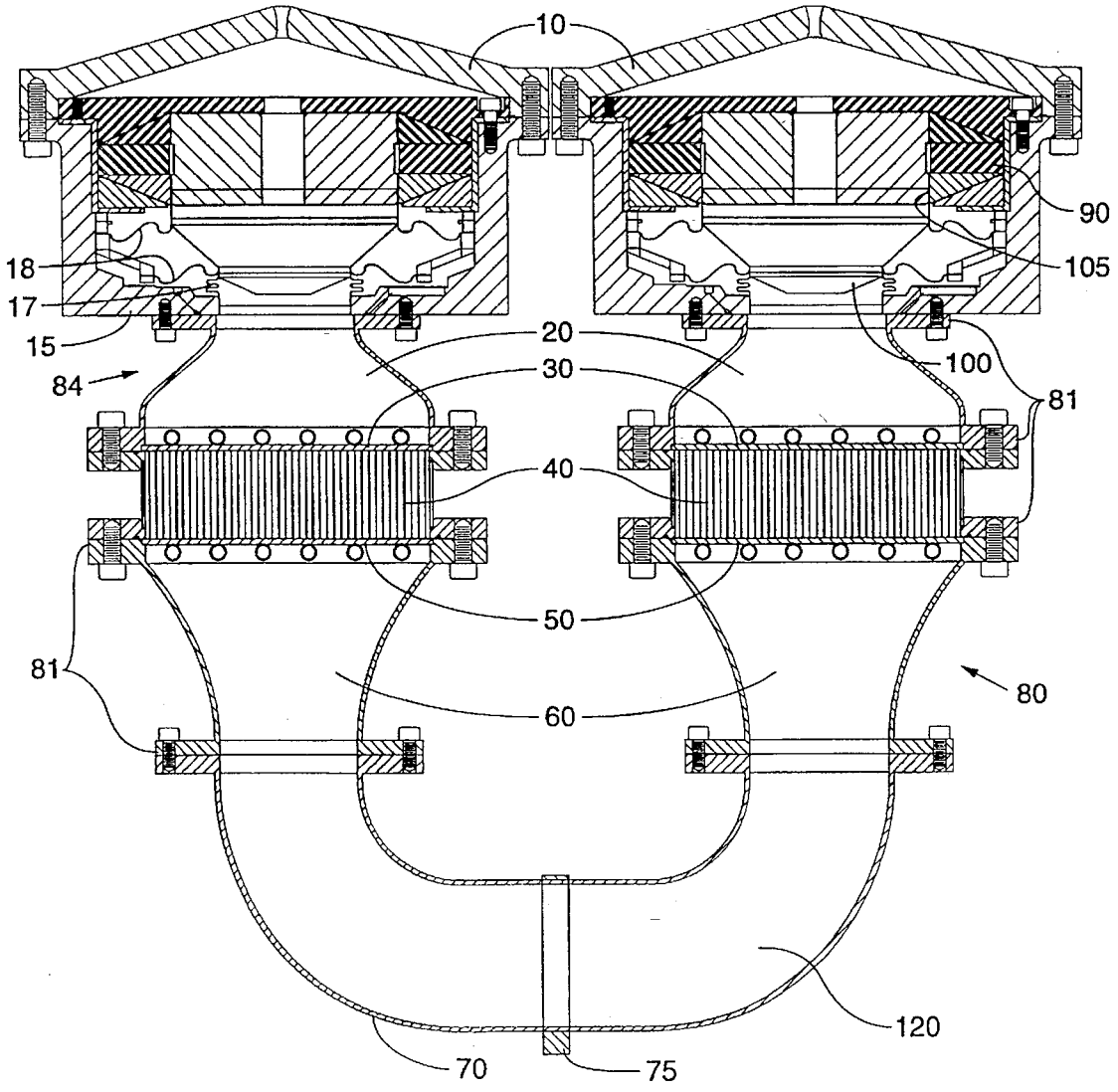
FIG. 1 is a cross-sectional view of the preferred embodiment of the high-powered thermoacoustic refrigerator heat-pump which employs two loudspeakers to excite the gas mixture which fills the resonator.

The preferred embodiment of the high-powered thermoacoustic refrigerator is shown in cross-section in FIG. 1. The refrigerator can be treated as two strongly coupled acoustical subsystems: (i) The loudspeakers 10 which convert alternating current to acoustical power; and (ii) the resonator 80 which contains the hot-side reducers 20, the hot-side heat exchangers 30, the stacks 40, the cold-side heat exchangers 50, the cold-side reducers 60, and the U-tube assembly 70. In another embodiment of this dual-loudspeaker design, the U-tube assembly can be made straight if the application favors a longer, thinner shape rather the shorter, broader shape of the preferred embodiment of FIG. 1.

In FIG. 1, the individual resonator components are shown as being connected by flanges 81. These flanges 81 were incorporated in the design to permit changes in the various components for research purposes. In a commercial design, the resonator 80 can be fabricated as a single piece without flanges 81. Further, the resonator 80 can be fabricated out of metallic or non-metallic materials by standard techniques (e.g., molding, extrusion, hydroforming, heat fusion, etc.) well known to those skilled in the art.

Loudspeakers

In order to pump large quantities of heat from low temperatures to higher temperatures, as required to produce refrigeration, the Laws of Thermodynamics require that correspondingly large amounts of work be performed. In a thermoacoustic refrigerator, this work is provided in the form of acoustical energy. For production of efficient and reliable thermoacoustic refrigeration, it is essential that this sound energy be generated efficiently and reliably.

In the preferred embodiment shown in FIG. 1, there are two loudspeakers (drivers) 10 which are connected to a source of electrical current in such a manner to force their pusher cones 100 to oscillate with a 180° phase difference. The current is provided at a frequency corresponding to that required to sustain a half-wavelength standing wave within the gas mixture 120 which fills the resonator 80 at a pressure of several (typically 20) atmospheres.

Figure 2:
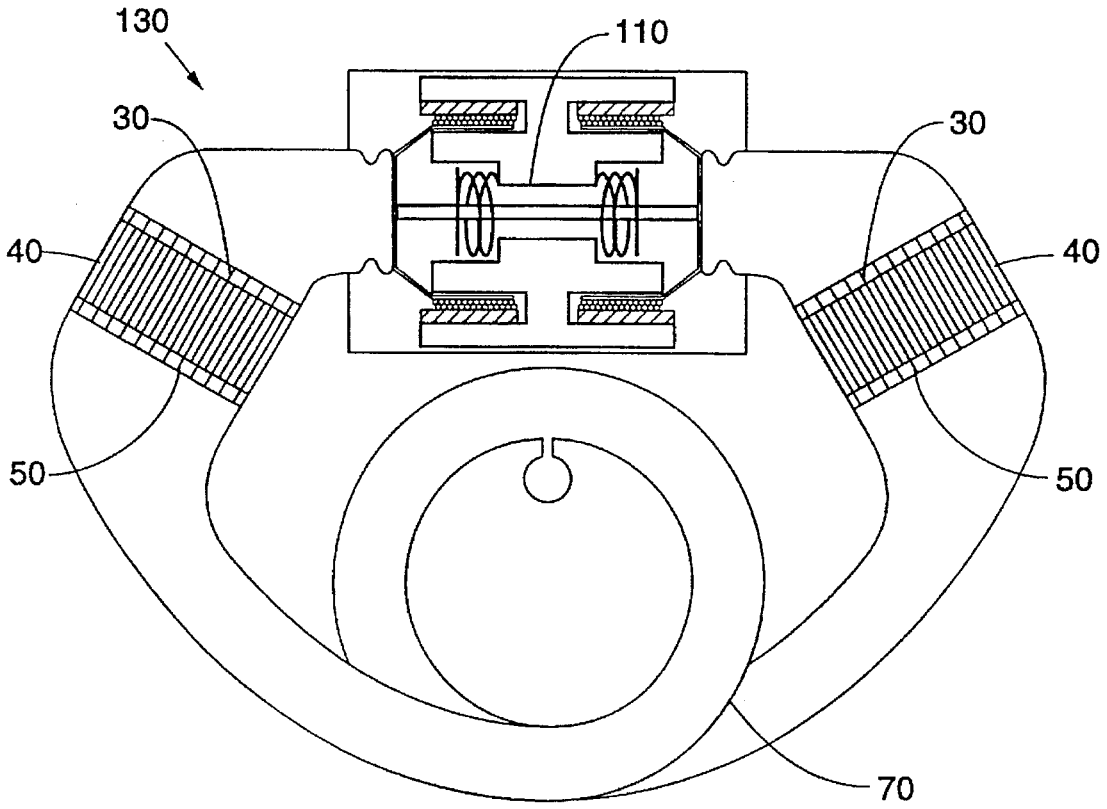
FIG. 2 is a view of an alternative embodiment which employs a single loudspeaker with a double-acting piston to excite the gas mixture in the resonator.

An alternative embodiment, shown in FIG. 2, employs a single loudspeaker 10 with a double acting piston 110 to excite the same half-wavelength resonant excitation of the gas 120 within the modified resonator 130. This alternative is shown with a longer U-tube section 70 that has greater angular curvature.

The loudspeakers 10 utilized in FIG. 1 are unlike conventional electrodynamic loudspeakers which are commonly used for reproduction of sound, since the thermoacoustic loudspeakers 10, are optimized for high efficiency operation over a much narrower range of frequencies. Force is applied to the pusher cones 100, by a voice coil 105 attached to one end of the pusher cones 100 which are placed within a magnet assembly 90. The other end of the pusher cones 100 are attached to the loudspeaker housing 15 using a metal bellows 17 which forms a gas-tight, flexible seal that allows the loudspeakers 10 to compress and expand the gas mixture 120 within the resonator section 80 at audio frequencies.

The proper alignment of the magnet assembly/voice coil/pusher cone/bellows assembly is maintained by annular metal springs 18 which also provide an elastic restoring force which will resonate with the moving mass of the voice coil/pusher cone/bellows. The use of metal springs 18 provides a low-loss resonant system which allows use of substantial mass moving in the loudspeaker 10 with minimal energy dissipation in the loudspeaker suspension. In one embodiment of this loudspeaker system, the moving mass was approximately 35 grams and the resonant frequency of the combined moving mass and steel spring suspension system was 320 Hz. In that device, each loudspeaker produced 110 Watts of useful acoustical power and only one Watt of power was dissipated by the mechanical losses within the loudspeaker, demonstrating the power and efficiency of the system.

Resonator Shape

The production of high-powered thermoacoustic refrigeration not only requires specialized components, such a loudspeakers and heat exchangers, but also demands that (i) these components be assembled in a structure which supports a high-amplitude standing acoustic wave at the required frequency and that (ii) the components occupy their proper positions in the standing wave field. The resonator 80 section of the high-powered thermoacoustic refrigerator provides the housing for these specialized thermoacoustic components and facilitates the transition between various components while also acting as the pressure vessel which contains the high pressure gas mixture 120 which is the working fluid for the thermoacoustic heat pumping cycle.

The shape of the resonator 80 is critical to the optimal functioning of this high-power thermoacoustic refrigerator. That resonator 80 shape is determined by the hot-side reducers 20, the hot-side heat exchangers 30, the stack sections 40, the cold-side reducers 50, and the U-tube assembly, 70. In addition to the reduction of the overall resonator thermoviscous dissipation, which was claimed in U.S. Pat. No. 4,722,201, this shape also functions to minimize turbulence generated by abrupt changes in resonator cross-sectional area. This was an additional loss mechanism in the U.S. Pat. No. 4,722,201 design, which used a bulb to provide a quarter-wavelength acoustical resonance condition. The changes in the resonator cross-section also suppresses the formation of shock waves in the resonator 80 since the acoustical overtones for this resonator geometry are not harmonically related to the fundamental half-wavelength resonance. Since the overtone frequencies are not integer multiples of the fundamental frequency, they therefore do not contribute to the resonant reinforcement of the harmonic overtones which characterize shock wave development. The development of shock waves and/or the cascade of acoustical energy from the fundamental frequency to higher harmonics could result in a substantial reduction in the thermoacoustic refrigerator coefficient-of-performance characterized by the ratio of the useful heat removed by the cold end of the refrigerator to the energy required by the refrigerator to transport that useful heat load.

The apparent "bulge" in the heat exchanger/stack section 30/40/50 is not as large acoustically as it appears to be physically in the scale drawing shown in FIG. 1. Those sections contain both tubes 32 and fins 34 of the heat exchangers and the stack material as shown in FIG. 3 and FIG. 3A. The solid material contained in both of these components occlude approximately 25% of the resonator cross-sectional area. These heat exchangers 30, 50 and stack elements 40 have been chosen so that there is not a large or abrupt change in the open (gas filled) cross-section in those portions of the resonator 80. By maintaining a fairly constant occlusion fraction, the accelerations and decelerations of the acoustically oscillating gas 120 are minimized as the gas 120 passes through the resonator sections which are partially filled with the heat exchanger tubes 32, fins 34 and stacks 40, again reducing losses caused by turbulent gas flows.

The cold-side reducers 60 provide a smooth transition, again to reduce turbulence to the U-tube section 70 in order to exploit the reduced thermoviscous dissipation provided by the reduced diameter of the U-tube section 70 as claimed in U.S. Pat. No. 4,722,201.

The hot-side reducers 20 also provide a smooth transition from the loudspeaker bellows 17 diameter to the heat exchanger/stack section of the resonator 80. The length and diameter change of the hot-side reducers 20 are critical in both positioning the heat exchanger/stack sections in the proper location within the acoustic standing wave and in transforming the acoustical impedance of the resonator to the value required to provide an optimal "lead" to the loudspeakers 10. If the acoustical impedance value that the resonator presents to the loudspeakers 10 is too large, then greater forces and hence larger electrical currents are required to provide those forces. These larger currents produce excess electrical dissipation (Joule heating) which reduces electro-acoustic energy conversion efficiency. If, on the other hand, the acoustical impedance presented to the loudspeakers 10 is too small, then the pusher cone 100 and bellows 17 have to undergo larger excursions. These increased motions can increase metal fatigue on the bellows 17 and suspension springs 18 and can lead to a substantial reduction in the operating life of those loudspeaker components. The control of this acoustical lead impedance experienced by the loudspeakers 10 in conjunction with the choice of the bellows radiating area is essential for efficient and long-life operation of the refrigerator. In the preferred embodiment shown in FIG. 1, the acoustical impedance presented to the loudspeaker was approximately $30\times10^6$ Newton-sec/$m^5$ and the bellows effective (piston) area was 21 $cm^2$. Other choices for acoustical impedance and bellows area may be made to optimize the overall ratio of useful heat pumping power to electrical input power to the loudspeakers or to reduce metal fatigue.

The effective length of the hot-side reducers 20 is also critical for providing the optimal combination of heat pumping power and temperature span. If the length is too short, the temperature span will be excessive and the heat pumping power will be insufficient, while if the length is too long, the temperature span will be inadequate and the heat pumping power will be excessive. For the implementation shown in FIG. 1, the hot-side reducers were optimized for pumping 120 Watts of useful heat over a temperature span of 50° C., using 120 Watts of acoustical power supplied by the loudspeakers. The same system was also capable of pumping 420 Watts of useful heat load over a temperature span of 20° C. using 220 Watts of acoustical power provided by the loudspeakers.

The placement of the two loudspeakers 10 at the high acoustical impedance ends 84 of the resonator 80 reduces the requirement for large pusher cone excursions to provide high acoustic power. The presence of the second loudspeaker doubles the acoustical impedance which the first loudspeaker experiences, and vice versa. Since the high impedance ends 84 of the resonator 80 are also the high temperature ends of the refrigerator, the heat generated by the loudspeakers 10 does not present a direct thermal burden on the cold end of the refrigerator which also increases overall thermodynamic efficiency. This arrangement allows all of the cold components of the refrigerator (cold-side heat exchangers 50, cold-side reducers 60, and U-tube 70) to be separated from the hot side components (loudspeakers 10, hot-side reducers 20, and hot-side heat exchangers 30). This separation of the hot and cold components within the resonator 80 simplifies the application of thermal insulation to the cold side of the refrigerator and reduces extraneous heat loads on the cold side of the refrigerator.

Heat Exchangers

The thermoacoustic heat pumping, which takes place due to the action of the high amplitude standing wave within the stack section 40 of the resonator, is of little or no use unless that cooling power can be communicated to the heat load outside of the resonator 80. In addition, the First Law of Thermodynamics guarantees that the sum of the useful heat extracted from the load plus the work absorbed by the stack, which was required to pump that heat load from a lower temperature to a high temperature, must be exhausted from the system. The cold-side and hot-side heat exchangers are required to perform both the useful heat extraction and exhaust functions of the thermoacoustic refrigerator.

A typical embodiment of the heat exchanger design is shown in FIG. 3 and FIG. 3A. It consists of a serpentine tube 32 which contains a transport fluid. For this preferred embodiment, the fluid within the hot-side tubing is water and on the cold-side it is an alcohol with a low freezing temperature. Another embodiment could substitute heat pipes for the serpentine tube. The tube 32 is attached to a series of thin parallel fins 34 made of a material of high thermal conductivity, such as copper, silver or aluminum. Special care is taken to insure that there is minimal thermal resistance between the tubing 32 and fins 34 at their junctions. The spacing between the tubes is chosen to provide high fin efficiencies. See for example: S. L. Garrett "ThermoAcoustic Life Sciences Refrigerator: Heat Exchanger Design and Performance Prediction", unpublished, S. L. Garrett, D. K. Perkins and A. Gopinath, "Thermoacoustic Refrigerator Heat Exchangers: Design, Analysis and Fabrication," *Heat Transfer* 1994, proceedings of the Tenth International Heat Transfer Conference, Vol 4, pp 375–380 (1994), and F. M. White, *Heat and Mass Transfer,* (Addision-Wesley, 1988), pg. 91.

This new heat exchanger differs from the conventional gas-to-liquid heat exchangers, such as an automobile radiator, because the fins 34 have a much higher density (typically fifty or more fins per inch) and a short length (typically 0.10" or less), and because the fin 34 is placed only on the leading edge of the tube 32. In a conventional gas-to-liquid heat exchanger, the tubes pass through the fins which have much greater spacing and are much longer in the direction of flow. The reason the high-power gas-to-liquid thermoacoustic heat exchangers are designed differently is that the gas 120 within the heat exchanger undergoes acoustical oscillations with peak-to-peak displacements which are small (typically 0.10"). Any additional fin length would only produce additional thermoviscous losses without increasing the convective heat transport. The fin density can be large because the gas used in the thermoacoustic refrigerator is under a pressure which is many times greater than atmospheric pressure.

Quasi-Cascade Heat Exchanger Connection

Since the new high-power thermoacoustic refrigerator has two stacks 40, two cold-side heat exchangers 50, and two hot-side heat exchangers 30, there are two possible ways in which to arrange the flow of the heat transport fluid between the heat exchangers.

One method would be to connect the cold-side heat exchangers 50 in parallel and the hot-side heat exchangers 30 in parallel. Although such a parallel arrangement would lower the flow resistance of the heat transport fluids within the heat exchanger tubing, such an arrangement could lead to an instability if the viscosity of the cold-side heat transport fluid increases with decreasing temperature. This instability would occur when one of the cold-side heat exchangers 50 became even slightly colder than the other. In that case, the fluid flow in the colder cold-side exchanger would decrease due to the increased fluid viscosity of the heat transport fluid, while the flow through the hotter cold-side heat exchanger increased. The colder cold-side exchanger would then become even colder due to the decreased fluid flow and could eventually shut off flow completely. This could be avoided by a valve and control system but that strategy would add complexity and increase production cost while decreasing reliability. The parallel fluid choice is also not optimal in the thermodynamic sense.

Figure 4:
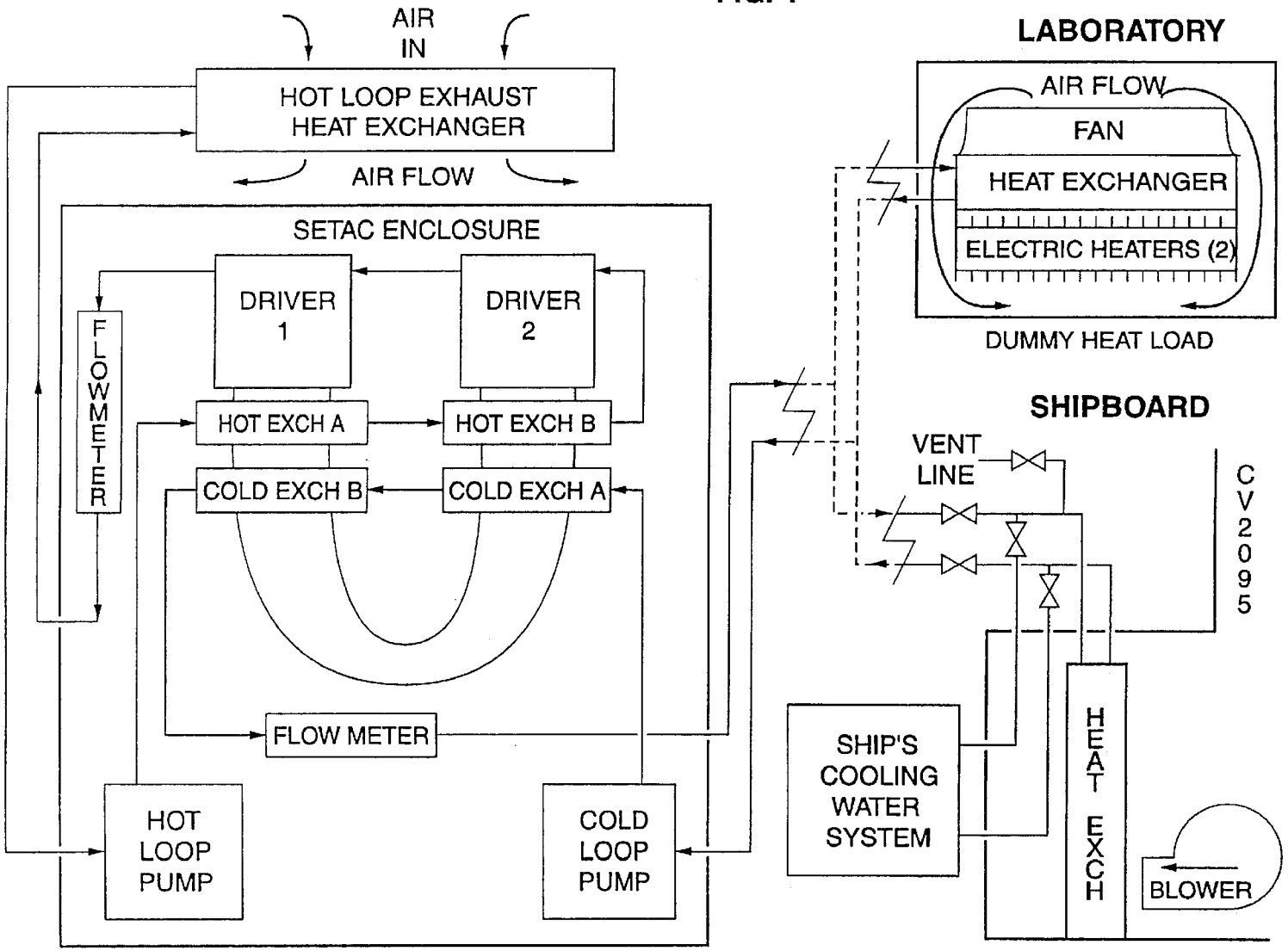
FIG. 4 is a schematic illustration of a thermoacoustic heat-pump in coordination with two possible refrigeration units for cooling.

If the transport fluid flow within the two hot-side heat exchangers 30 and the two cold-side heat exchangers 50 are arranged in series and in opposite directions as illustrated in FIG. 4, then the instability could not occur. In addition, due to the counter-flow arrangement of the hot and cold fluid flow paths, the required temperature span across either stack is reduced below what is required for both stacks in the parallel flow arrangement for any given total required temperature span. The theoretically maximum performance of any refrigerator, based on the First and Second Laws of Thermodynamics, is determined only by the temperature of the cold-side heat exchanger divided by the temperature difference between the hot-side and cold-side heat exchangers. The Quasi-Cascade series fluid flow path used in this high-power thermoacoustic refrigerator requires a lower temperature span for each individual stack/exchanger section than the parallel fluid flow path and, therefore, can provide more cooling for the same amount of work.

Stacks

This new high-powered thermoacoustic refrigerator can accommodate any type of stack geometry, e.g., spiral, channel, or pin stack, and no claim is made for any novel or unique stack in this specification.

Co-Resonant Tuning with Gas Mixtures

With the introduction of low-loss resonant loudspeakers 10 described earlier, and the requirement that the acoustical system be operated at the acoustical resonance determined by the thermoacoustic resonator 80 presents a tuning problem. The optimal performance of the refrigerator only occurs when both the loudspeakers 10 and the resonator 80 have the identical resonance frequency. The loudspeakers 10 and the resonator 80 form a strongly coupled resonant system. If the resonant frequency of the resonator 80 is higher (or lower) than that of the loudspeakers 10, then a significant fraction of the force produced by the current passing through the voice coil 105 is required to overcome the inertia of the moving mass (or the stiffness of the suspension) instead of being delivered directly to the useful acoustical load of the resonator 80. This additional stiffness or mass reactance of the loudspeakers 10, when operated off of their mechanical resonance frequency, which is due to the de-tuning of the two acoustically coupled systems, also results in the production of a significant reactive component in the electrical impedance of the loudspeaker voice coils 105.

This new high-powered thermoacoustic refrigerator uses an adjustable binary mixture of inert gases 120 to permit tuning the gas to a precise coincidence of the resonance frequencies of the two strongly coupled resonant systems. This objective is accomplished by varying the average atomic weight of an inert gas mixture 120. In the preferred embodiment, mixtures of Helium and Argon, or Helium and Xenon have been used, although other gas mixtures could be used to achieve the tuning objective.

The resonance frequency of the resonator 80 in the half-wavelength fundamental mode, f, is determined by the ratio of the sound speed in the gas mixture, $a_{mix}$, to the effective length, $L_{eff}$, of the half-wavelength resonator by the following equation: $f=a_{mix}/2L_{eff}$. This effective length is related to the physical length of the resonator 80 but is not equal to it due to the fact that the resonator 80 is not a straight tube of uniform cross-section. The speed of sound squared, $a^2_{mix}$, in a mixture of two ideal inert gases is determined by the atomic weights of the individual constituents, $M_1$ and $M_2$, the absolute (Kelvin) temperature of the gas mixture, T, and the Universal Gas Constant, $R=8.3143\ J^\circ\ K^{-1}\ mol^{-1}$, as shown in the equation below when the mole fraction of component 1 is x:

$$a^2_{mix}=\frac{5RT}{3(xM_1+(1-x)M_2)}$$

The precise tuning condition can then be established by tuning the acoustical resonance frequency of the resonator 80 to the mechanical resonance frequency of the loudspeakers 10 as measured before their attachment to the resonator 80. The resonance frequency coincidence then can be re-confirmed by observing that the correct frequency also creates a local minimum in the electrical impedance of the loudspeaker voice coils 105 and that the electrical impedance at that minimum is almost entirely resistive with a minimum reactive component.

In addition to providing the optimum acoustical energy transfer from the loudspeakers 10 to the resonant acoustic load, this tuning also produces the minimum in the electrical impedance of the voice coils 105. The fact that the electrical impedance is overwhelmingly resistive and not reactive under these same tuning conditions guarantees that the transfer of power from the electrical current source to the loudspeaker voice coil will also be optimal (Power Factor≈1.0). Therefore, the maximum current (and hence the maximum force) will be available with the minimum voltage requirement.

Variations

In addition to the above described embodiment, several variations are possible. One such variation would utilize a dual-stack 40 thermoacoustic refrigerator which uses a single loudspeaker 10 with a double-acting piston 110, as shown in FIG. 2, or larger numbers of multiple stack 40 pairs. For example, two double-acting loudspeakers driving two resonators, each resonator containing two stacks and two heat exchangers pairs for a total of four stacks as one example of multiple stack pairs. Greater numbers could also be used.

Another variation would utilize a resonant loudspeaker which uses transduction mechanisms other than the electrodynamic force of a current carrying voice coil within a permanent magnetic field, Such alternative transduction mechanisms may include, but are not limited to, piezoelectricity, ferroelectricity, magnetostriction, variable reluctance, etc., or other non-metallic low-loss elastic suspension material such as ceramics, graphite or composite materials.

Embodiments utilizing other mixtures of gases which may not be inert or mixtures which contain more than two components may also be constructed.

Other arrangements of tube (e.g., parallel instead of serpentine) or fins (e.g., radial instead of linear)within the stacks may be utilized.

Additionally the Quasi-Cascade arrangement can be extended by segmenting the individual stacks and interspersing multiple heat exchangers along the stack instead of using only one heat exchanger at each end of the existing stacks.

Obviously many modifications and variations of the present invention are possible in light of the above teachings. It is, therefore, to be understood that the present invention may be practiced within the scope of the following claims other than as specifically described.

What is claimed is:

1. A high-power thermoacoustic refrigerator comprising:

a half-wave length resonator;

at least two housings mounted at first and second ends of said resonator, said housings having a driver disposed therein;

a plurality of heat exchangers disposed in said resonator, in close proximity to said drivers;

at least two stacks disposed within said heat exchangers;

a compressible fluid disposed within said resonator, said fluid being tuned to the half-wave length resonance of said resonator;

at least two high acoustical impedance ends of said resonator of non-uniform cross-section mounted proximate to said drivers for containing said compressible fluid;

a plurality of transport fluids disposed in said heat exchangers for transferring heat;

a plurality of voice coils wired with a 180 degrees phase difference disposed in said divers; and a plurality of pusher cones disposed in said drivers, said cones having a bellows and springs proximate to said voice coils for compressing said compressible fluid to an oscillating standing half-wave length in the resonator, whereby the oscillating fluid efficiently pumps heat during operation.

2. The high-power thermoacoustic refrigerator of claim 1, wherein:

said resonator is selected to have the resonance frequency of said drivers:

said compressible fluid is an adjustable binary mixture of inert gases selected to coincide with the resonance frequency of the resonator and drivers; and said bellows forming a seal between said housing and said pusher cones.

3. A high-power thermoacoustic refrigerator comprising:

a half-wave length resonator;

at least two housings having loudspeakers disposed therein fixedly mounted at first and second ends of said resonator;

a plurality of heat exchangers disposed in said resonator in close proximity to said loudspeakers;

at least two stacks disposed within said heat exchangers;

a compressible fluid disposed within said resonator, wherein said fluid is an adjustable binary mixture of inert gases capable of being tuned to the half-wave length resonance of said resonator and said loudspeakers;

at least two high acoustical impedance ends of said resonator of non-uniform cross-section deposed in said resonator for containing said compressible fluid proximate to said stacks and said heat exchangers;

a plurality of transfer fluids disposed in said heat exchangers for transferring heat;

a plurality of voice coils wired 180 degrees out of phase disposed in said loudspeakers for oscillating said compressible fluid;

a plurality of pusher cones proximate to said voice coils for compressing and decompressing said compressible fluid during the oscillating of a standing half-wave length in the resonator to efficiently transfer heat from the heat exchangers during operation;

a plurality of bellows disposed between said pusher cones and said housing and forming a flexible seal between said housing and said resonator; and a plurality of mounting springs disposed within said housings for mounting said pusher cones wherein said pusher cones are disposed between said bellows and said springs for maintaining proper alignment of said pusher cones within said housings.

4. The high-powered thermoacoustic refrigerator of claim 3, wherein:

said heat exchangers have a tube mounted therein for containing said transfer fluid for transferring heat and cold from said resonator; and said tubes having short fin length and high fin density attached thereto for said compressible fluid mixture to oscillate therein and transfer heat to and from said stacks.

5. A high-power thermoacoustic refrigerator comprising:

a half-wave length resonator;

at least one housing fixedly mounted to first and second ends of said resonator, said housing having a at least one loudspeaker with a double-acting piston disposed therein;

a plurality of heat exchangers disposed in said resonator, proximate to said loudspeaker;

at least two stacks disposed within said heat exchangers;

a compressible fluid disposed within said resonator, said fluid being tuned to the half-wave length resonance of said resonator;

at least two high acoustical impedance ends of said resonator of non-uniform cross-section fixedly mounted proximate to said double-acting pistons for containing said compressible fluid;

a plurality of transport fluids disposed in said heat exchangers for transferring heat;

a plurality of voice coils wired with a 180 degrees phase difference disposed in said loudspeaker; and a plurality of pusher cones disposed in said loudspeaker, said cones having a bellows and springs proximate to said voice coils for compressing said compressible fluid to an oscillating standing half-wave length in the resonator, whereby the oscillating fluid efficiently pumps heat during operation.

6. The high-powered thermoacoustic refrigerator of claim 5, wherein:

said heat exchangers have a tube mounted therein for containing said transfer fluid for transferring heat and cold from said resonator; and said tubes having short fin length and high fin density attached thereto for said compressible fluid mixture to oscillate therein for heat transfer.

* * * * *